United States Patent [19]

Tsuchiyama

[11] 4,224,858

[45] Sep. 30, 1980

[54] STROKE-ADJUSTING DRIVE MECHANISM FOR MACHINES

[75] Inventor: Yuji Tsuchiyama, Hadano, Japan

[73] Assignee: Amada Company, Limited, Isehara, Japan

[21] Appl. No.: 928,900

[22] Filed: Jul. 28, 1978

[30] Foreign Application Priority Data

Jul. 30, 1977 [JP] Japan ..... 52-91633

[51] Int. Cl.[3] ..... F15B 13/04; F01B 3/00; F01B 31/00

[52] U.S. Cl. ..... 91/410; 91/445; 92/110; 92/114

[58] Field of Search ..... 91/410, 451, 445, 404; 92/110, 114

[56] References Cited

U.S. PATENT DOCUMENTS

| | | | |
|---|---|---|---|
| 1,877,701 | 9/1932 | Speck et al. | 91/410 |
| 3,041,963 | 7/1962 | Hazelton et al. . | |
| 3,241,350 | 3/1966 | Giordano . | |
| 3,327,515 | 6/1967 | Beyeler . | |
| 3,768,371 | 10/1973 | Prme | 91/451 |
| 4,151,978 | 5/1979 | Frei | 91/404 |

FOREIGN PATENT DOCUMENTS

| | | | |
|---|---|---|---|
| 281472 | 12/1927 | United Kingdom | 91/410 |

*Primary Examiner*—Paul E. Maslousky
*Attorney, Agent, or Firm*—Wigman & Cohen

[57] ABSTRACT

A stroke-adjusting drive mechanism in which the stroke of a reciprocating member, such as a piston, is adjustable for use in machines such as hydraulic presses and press brakes is disclosed. The apparatus includes a cylinder and piston with a piston rod member which projects outwardly from the cylinder. A restricting valve means is arranged between a chamber of the cylinder defined by the piston member and a hydraulic passage connected with a hydraulic pump. An adjusting member is arranged in the piston rod member so as to be adjustably positioned along the axis thereof and a regulating valve is provided for restricting the flow of hydraulic fluid from the first chamber in response to changes of pressure and the hydraulic passage. By means of the apparatus of the present invention, the stroke length of the piston member can be easily and precisely adjusted as well as stopped at a desired position.

2 Claims, 3 Drawing Figures

STROKE-ADJUSTING DRIVE MECHANISM FOR MACHINES

BACKGROUND OF THE INVENTION

1. Field of the Invention

The present invention relates to a hydraulic driving mechanism of a piston and cylinder type and more particularly pertains to a stroke-adjusting driving mechanism in which the stroke of a reciprocating member, such as a piston is adjustable for use in machines such as, for example, hydraulic presses and press brakes.

2. Description of the Prior Art

In machine tools such as presses and planing machines for example in which a tool or a ram having a tool is reciprocated by a hydraulic cylinder or motor having a piston and piston rod, it is necessary to adjust the stroke length of the piston rod to stop the tool at a desired position. Also, it is often necessary to stop the tool at will in order to adjust the stroke length of the piston rod. In hydraulic presses for bending sheet metals, for example, it is necessary to precisely adjust the stroke length of the ram to stop an upper tool at an optimum position with regard to a cooperating lower tool depending upon the thickness of sheet metals to be bent and the angles to be formed in the sheet metals. Also, it is often desired to stop and move at will the ram in initially setting the tools and adjusting the stroke length of the ram particularly in so-called air bending operations, for example.

Heretofore, several measures have been employ to stop the piston and piston rod in hydraulic driving mechanisms for machines such as hydraulic presses. For example, an actuating means such as a micro switch is so provided that it will transmit a signal to a solenoid operated valve assembly to stop the piston and piston rod when the valve assembly is actuated. As another example, the piston is so arranged as to be forcibly stopped by a stop member with a force exceeding the hydraulic force of the hydraulic motor. Also, in another conventional technique, a valve is disposed in the hydraulic circuit for urging the piston and piston rod so that it may exhaust the hydraulic fluid to stop the piston and piston rod when the piston rod has reached a predetermined position.

However, all of the conventional measures for stopping the piston and piston rod have suffered from serious shortcomings. In the use of an actuating means such as a micro switch, a considerable time elapses until the piston is stopped after the actuation of the actuating means, and therefore the piston rod cannot be stopped at a desired position.

In case of forcibly stopping the piston rod with the use of a stop member, a large force is required, and for this reason it is impossible to stop the piston rod while maintaining a force on the piston with the hydraulic fluid. Also, in the technique of using a valve for exhausting the hydraulic fluid, the valve will experience variations in opening area depending upon the hydraulic pressure, and therefore the piston and piston rod cannot be stopped at a desired position. Furthermore, in the case of any of the conventional techniques, it is impossible to stop and move as necessary the piston and piston rod, let alone stop the same while keeping the piston pressed by the hydraulic fluid.

OBJECTS OF THE INVENTION

It is an object of the present invention to provide a hydraulic drive mechanism in which the stroke length of the piston member can be easily and precisely adjusted.

It is another object of the present invention to provide a hydraulic drive mechanism in which the piston member can be precisely stopped at a desired position.

It is another object of the present invention to provide a hydraulic drive mechanism in which the piston member can be stopped and moved as necessary.

It is a further object of the present invention to provide a hydraulic drive mechanism in which the piston member can be stopped while kept pressed by the hydraulic fluid.

Basically, these objects are accomplished by providing a hydraulic drive motor of a specific cylinder with two valve means which are arranged to cooperate with each other to drain the hydraulic fluid to the hydraulic source when the piston member has reached a predetermined position.

Other and further objects and advantages of the present invention will be apparent from the following description and accompanying drawings which, by way of illustration, shown a preferred embodiment of the present invention and the principle thereof.

DESCRIPTION OF THE PREFERRED EMBODIMENTS

Figure 1:
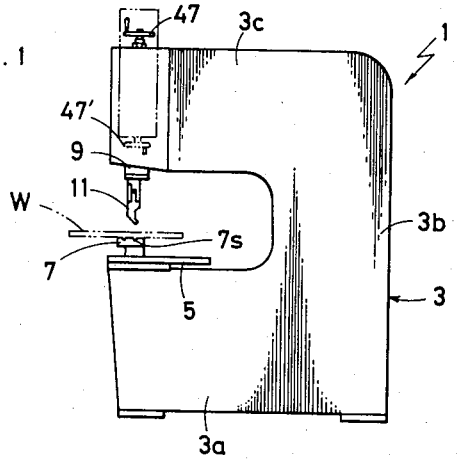
FIG. 1 is a side elevational view of a hydraulic press in which the stroke-adjusting drive mechanism according to the present invention can be incorporated.

Referring to FIG. 1, the present invention will be described as embodied with a hydraulic press which is generally designated by the numeral 1. However, it will be understood that the invention has broad applicability to any machine in which the stroke of a reciprocating member is required to be adjustable.

The hydraulic press 1 shown in FIG. 1 is conventionally constructed with a C-shaped frame 3 having a base 3*a*, an upright portion 3*b* and an overhead assembly 3*c* and is provided at its front lower portion with a worktable 5 on which a lower die or tool 7 shown in FIG. 1 as having V-shaped slots 7*s* is fixed. The press 1 is also provided at its front upper portion with a ram 9 which is vertically movable toward and away from the lower die 7. At the lower end of the ram 9, an upper die or tool 11 is affixed by means of an attachment. Thus, when the ram 9 is lowered toward the lower die 7 on which a workpiece W, such as sheet metal has been placed, the upper and lower dies 11 and 7 will cooperate with each other to process and form the workpiece W.

Figure 2:
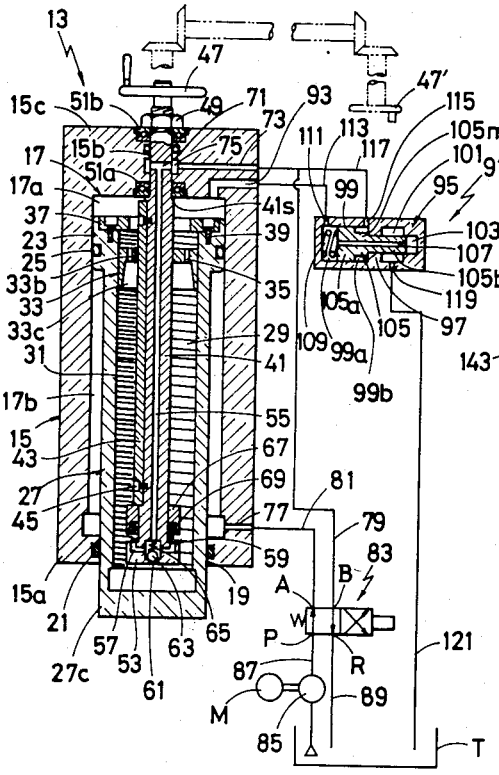
FIG. 2 is a cross-sectional, partly schematic view of an embodiment of the stroke-adjusting drive mechanism according to the present invention and a hydraulic circuit.

Referring to FIG. 2, there is shown a hydraulic drive motor assembly 13 which can be employed with the hydraulic press 1 shown in FIG. 1 to drive the ram 9 of the same. The hydraulic drive motor assembly 13 comprises a hydraulic cylinder 15 which has an interior chamber 17 closed at one end thereof by a closed portion 15c and provided at its other end with a circular opening 19 having a seal 21. The hydraulic cylinder 15 includes therein a specific piston member 23 which has a piston ring 25 as is conventional, but is characterized in that the piston is integrally provided with a hollow cylindrical piston rod 27 having a cylindrical interior chamber 29. The piston member 23 is formed so as to have the cylindrical chamber 29 in common with the piston rod 27, and the cylindrical chamber 29 opens outwardly to the interior chamber 17 of the hydraulic cylinder 15 through the piston member 23. Thus, the chamber 17 of the hydraulic cylinder 15 is divided into two chambers 17a and 17b by the piston member 23 and the piston rod 27, and the interior chamber 29 of the piston rod 27 is functionally connected with the chamber 17a to define essentially a single chamber. Also, the cylindrical piston rod 27 is closed at its end 27c, and slidably fits in the circular opening 19 of the hydraulic cylinder 15 so as to project outwardly therefrom. Thus, the piston member 23 is actually a container-shaped cylinder which is provided at its open end with a flange, and the piston member 23 and the piston rod 27 integrally function as both a usual piston and a usual piston rod. The piston rod 27 is extended downwardly out of the hydraulic cylinder 15 when the hydraulic fluid is pressurized in the chambers 17a and 29 of the hydraulic cylinder 15 and the piston rod 27, respectively, and it is retracted into the hydraulic cylinder 15 when the hydraulic fluid is pressurized in the chamber 17b of the same.

The cylindrical piston rod 27 of the hydraulic drive motor assembly 13 is formed at its overall inner wall with a thread 31, and an adjusting screw member 33 is engaged with the thread 31 so that it may be axially moved in the chamber 29 of the piston rod 27 when rotated. The adjusting screw member 33 is a disk which is preferably formed with a concavity 33c on the side thereof confronting the closed end 27c of the piston rod 27, and it is formed with a plurality of bores 35 so that the hydraulic fluid is free to flow therethrough. Also, a ring member 37 is fixed to the open end of the chamber 29 of the piston rod 27 by fastening means such as a plurality of bolts 39 so as to retain the adjusting screw member 33 in the chamber 29. As will be understood hereinafter as the description proceeds, the adjusting screw member 33 is provided to adjust the stroke length of the piston rod 27.

The adjusting screw member 33 of the piston rod 27 is so designed as to be adjustingly rotated by an elongate rotatable adjusting shaft 41 and an elongate spline-like key member 43 which are both slidably passed through a bore 33b formed through the adjusting screw member 33. The adjusting shaft 41 is so disposed along the axial center of the hydraulic cylinder 15 and the piston rod 27 as to extend from the closed portion 15c of the hydraulic cylinder 15 to the vicinity of the opening 19 of the same and pass through the axial center of the adjusting screw member 33. Also, the spline-like key member 43 is fixed to the adjusting shaft 41 in parallel with the axial center thereof by suitable means such as a plurality of bolts 45, and it is of a length corresponding to the maximum stroke length of the piston rod 27 as will be understood as the description proceeds. Thus, the adjusting screw member 33 is rotated by the spline-like key member 43 when the adjusting shaft 41 is rotated, and it can be moved along the length of the adjusting shaft 41 and the spline-like key member 43. Accordingly, the adjusting screw member 33 is moved in the piston rod 27 along the thread 31 thereof when rotated by the adjusting shaft 41 and the spline-like key member 43, and it is also moved, together with the piston rod 27, along the adjusting shaft 41 and the spline-like key member 43 when the piston rod 27 is moved in the hydraulic cylinder 15. In this connnection, it will be understood that the piston rod 27 is prevented from rotating in the hydraulic cylinder 15 insofar as it is fixed to the ram 9 which is guided for travelling by a guide means in the hydraulic press 1.

The adjusting shaft 41 for rotating the adjusting screw member 33 is rotatably supported or journaled in a bore 15b formed through the closed portion 15c of the hydraulic cylinder 15, and it projects outwardly therefrom for rotation by a handwheel 47 fixed to the extreme end thereof. In the arrangement, the adjusting shaft 41 is made reduced in diameter to have an annular shoulder 41s at its end to be supported, and it is provided at its projecting end with a nut 49 engaging a thread formed thereon. Also, a pair of annular thrust bearing assemblies 51a and 51b are provided at annular concavities which are formed on the inside and the outside, respectively, of the bore 15b in such a manner as to surround the adjusting shaft 41. Thus, the adjusting shaft 41 is freely rotatably held at the closed portion 15c of the hydraulic cylinder 15 when the nut 49 is tightened, and it is rotated to rotate the adjusting screw member 33 in the piston rod 27 when the handwheel 47 is rotated.

In this connection, it will be readily understood that the adjusting shaft 41 may be so arranged as to be indirectly rotated by a handwheel 47' by means of suitable means such as bevel gears as shown in the imaginary lines in FIG. 2, although it is shown by the continuous lines as directly fixed with the handwheel 47. Also, the handwheel 47' arranged as shown by the imaginary lines in FIG. 2 may be mounted on the hydraulic press 1 as shown by the imaginary lines in FIG. 1.

The adjusting shaft 41 described above is provided at its free inner extreme end with a flanged portion 53, and also it is formed at its axial center with an elongate hydraulic passage 55 extending from the journaled portion of the adjusting shaft 41 to the flanged portion 53 of the same. As will be described hereinafter, the hydraulic passage 55 leads from and to the hydraulic source, and the hydraulic fluid for extending the piston rod 27 flows into and out of the hydraulic cylinder 15 through the passage 55. The adjusting shaft 41 is also provided at its flanged portion 53 with a plurality of radial passages 57 which radially extend from the passage 55 and are axially opened toward the adjusting screw member 33 through ports 59. The adjusting shaft 41 is further provided at its flanged portion 53 with an axial port 61 which is so formed as to be connected with the passage 55 and open toward the closed end 27c of the piston rod 27 but is usually kept closed by a ball valve member 63 biased thereto by a spring 65. Thus, the hydraulic fluid is brought into the hydraulic cylinder 15 through the passages 55 and 57 and the ports 59 in order to extend the piston rod 27, while it is exhausted therefrom from the port 61 as well as the ports 59 and the passages 57 and through the passage 55 when the piston rod 27 is to be retracted. Of course, the hydraulic fluid having been supplied into the hydraulic cylinder 15 will prevail and increase or reduce in pressure simultaneously or equally in both of the chambers 29 and 17 of the piston rod 27 and the hydraulic cylinder 15, respectively, since they are connected with each other through the bores 35 of the adjusting screw member 33.

In this connection, the flanged portion 53 of the adjusting shaft 41 may be actually a separate member provided at the end of the adjusting shaft 41, although it has been described in the above as integrally formed at the end of the adjusting shaft 41. Also, the passages 57 and the ports 59 may be a dish-like space or clearance which is provided between the end of the adjusting shaft 41 and such a separate member used for the integral flanged portion 53 described above. For example, a disk-like member having a concavity can be disposed at the end of the adjusting shaft 41 in place of the integral flanged portion 41 described above in such a manner as to provide a dish-like space acting as both of the passages 57 and the ports 59.

In order to restrict or throttle the hydraulic fluid flowing into the hydraulic cylinder 15, a restricting valve member 67 is slidably provided at the end of the adjusting shaft 41 between the flanged portion 53 thereof and the end of the spline-like key member 43 fixed thereto. The restricting valve member 67 is a disk-like member formed with a concavity confronting the flanged portion 53 of the adjusting shaft 41 and slidably surrounding the adjusting shaft 41, and it is so designed as to close the ports 59 of the flanged portion 53 of the adjusting shaft 41 when brought into contact therewith. Also, the restricting valve member 67 is usually kept biased away from the flanged portion 53 of the adjusting shaft 41 by a spring 69 which may be plural in number so as to allow the hydraulic fluid to flow into the hydraulic cylinder 15 from the ports 59. Thus, the restricting valve member 67 is moved by the adjusting screw member 33 toward the flanged portion 53 of the adjusting shaft 41 against the spring 69 to gradually close or restrict the hydraulic ports 59 when the piston rod 27 is moved together with the adjusting screw member 33 to extend out of the hydraulic cylinder 15. In this connection, the bores 35 of the adjusting screw member 33 are so formed that they will not be closed by the restricting valve member 67 when the adjusting screw member 33 is brought into contact therewith.

Also, as will be described in greater detail hereinafter, the hydraulic fluid is partially drained from the chamber 17*a* of the hydraulic cylinder 15 when the hydraulic ports 59 are at the point of being closed or are restricted by the restricting valve member 67. Accordingly, the piston rod 27 is stopped from extending out of the hydraulic cylinder 15 when the adjusting screw member 33 is so moved as to bring the restricting valve member 67 close to the flanged portion 53 of the adjusting shaft 41. Thus, it will be understood that the stroke length of the piston rod 27 can be adjusted by changing the location of the adjusting screw member 33 in the piston rod 27 by rotating the handwheel 47, 47'.

The hydraulic passage 55 of the adjusting shaft 41 is connected at its end opposite to the radial passages 57 with a radial passage 71 which may however be plural in number and is formed radially therefrom to outwardly open at the closed portion 15*c* of the hydraulic cylinder 15. Also, the radial passage 71 is connected with a passage or port 73 formed through the closed portion 15*c* of the hydraulic cylinder 15 to outwardly open through an annular passage 75 which is formed at the junction between the passage 71 and the port 73 in such a manner as to surround the adjusting shaft 41. Thus, the hydraulic fluid for extending the piston rod 27 is supplied into and exhausted from the hydraulic cylinder 15 through the port 73 formed at the closed portion 15*c* of the hydraulic cylinder 15 and the annular passage 75 and the passage 55 formed at the adjusting shaft 41, and vice versa.

On the other hand, the hydraulic cylinder 15 is provided at its open end with a port 77 through which the hydraulic fluid for retracting the piston rod 27 into the hydraulic cylinder 15 is supplied and exhausted. The port 77 is formed in the proximity of the opening 19 of the hydraulic cylinder 15 so as to make the chamber 17 thereof outwardly open and connect with the hydraulic source.

The ports 73 and 77 formed through the hydraulic cylinder 15 are connected with a hydraulic tank T by conduits 79 and 81, respectively, through a solenoid operated valve assembly 83 which is of a two position type having ports A, B, P and R in the preferred embodiment. The solenoid operated valve assembly 83 is shown as so disposed that the ports A and B are connected with the conduits 81 and 79, respectively, while the port P is connected with a hydraulic pump 85 driven by a motor M through a conduit 87 and the port R is connected with a drain conduit 89 leading to the tank T. The solenoid operated valve assembly 83 is so arranged as to alternatively connect either of the conduits 79 and 81 with the pump P while connecting the other of them with the drain conduit 89. Thus, the hydraulic fluid is supplied into the chambers 29 and 17*a* of the piston rod 27 and the hydraulic cylinder 15 from the pump P through the passage 79 to extend the piston rod 27, and it is supplied into the chamber 17*b* of the hydraulic cylinder 15 through the passage 81 to retract the piston rod 27. Also, when the hydraulic fluid is being supplied into either of the chambers 17*a* and 17*b* of the hydraulic cylinder 15, it is exhausted from the other of them through the passage 79 or 81 to be returned to the hydraulic tank T through the solenoid operated valve 83 and the drain conduit 89.

In order to regulate the hydraulic fluid for extending the piston rod 27, there is provided a regulating valve assembly 91 which is connected with the chamber 17*a* of the hydraulic cylinder 15 through a port 93 formed thereto to sense the hydraulic pressure prevailing therein. The port 93 for this purpose is formed through the closed portion 15*c* of the hydraulic cylinder 15 so as to lead from the closed end of the chamber 17*a* of the same to outwardly open.

The regulating valve assembly 91 comprises a casing 95 which has chambers 99 and 101 separated from each other by a wall 97 and has also another chamber 103 formed coaxially connected with the chamber 101 and smaller in diameter than the same. The casing 95 of the regulating valve assembly 91 includes therein a spool member 105 which has a larger diameter portion 105*a*, an elongate smaller diameter portion 105*b* and a middle portion 105*m* between the portions 105*a* and 105*b* and also is formed at its overall axial center with an elongate hydraulic passage 107. The larger diameter portion 105*a* of the spool member 105 is slidably fitted in the chamber 99 of the casing 95, and the smaller diameter portion 105*b* of the same is slidably extended through a bore formed through the wall 97 of the casing 95 and is slidably fitted into the chamber 103. Also, the middle portion 105*m* of the spool member 105 is so designed as to be located in the chamber 99 of the casing 95 in contact with the wall 97 of the same to keep the larger diameter portion 105*a* spaced from the wall 97. Thus, the chamber 99 of the casing 95 is divided into two chambers 99a and 99b by the larger diameter portion 105a of the spool member 105. Also, the spool member 105 is biased toward the wall 97 of the casing 95 by a spring 109 disposed in the chamber 99a so as to keep the smaller diameter portion 105b disconnecting the chambers 101 and 103 from each other. Thus, the chamber 99a of the casing 95 is always connected with the chamber 103 through the hydraulic passage 107 formed through the spool member 105, but it is usually kept disconnected from the chamber 101 by smaller diameter portion 105b of the spool member 105 fitting in the chamber 103.

The chamber 99a of the regulating valve assembly 91 is formed with a port 111 and is connected with the port 93 of the hydraulic cylinder 15 through a conduit 113. On the other hand, the chamber 99b of the regulating valve assembly 91 is formed with a port 115 which is connected by a conduit 117 with the conduit 79 connecting between the port 73 of the hydraulic cylinder 15 and the solenoid operated valve assembly 83. Also, the chamber 101 of the regulating valve assembly 91 is formed with a port 119 to which a drain conduit 121 is connected to lead to the hydraulic tank T. Thus, the hydraulic fluid will flow from the chamber 17a of the hydraulic cylinder 15 into the chamber 99a of the regulating valve assembly 91 through the port 93, the conduit 113 and the port 111 and also into the chamber 103 of the same through the passage 107 of the spool member 105. Also, the hydraulic fluid in the conduit 79 will flow into the chamber 99b of the regulating valve assembly 91 through the conduit 117 and the port 115. Thus, the spool member 105 is forced toward the chamber 103 by the hydraulic pressure prevailing in the chamber 99a on one hand, and it is also forced away from the chamber 103 by the hydraulic pressures acting in both of the chambers 103 and 99b on the other hand. However, the spool member 105 is kept urged to the wall 97 by the spring 109 to keep the smaller diameter portion 105b thereof fit in the chamber 103 as far as the hydraulic pressure acting in the chamber 99b is equal or approximate to that prevailing in the chambers 99a and 103. As is readily apparent, the hydraulic pressure in the chamber 99b is equal to that prevailing in the chambers 99a and 103 when the ports 59 of the adjusting shaft 41 are not nor restricted by the restricting valve member 67 in the piston rod 27, since the chamber 99b is connected with the chamber 99a and 103 through the chambers 29 and 17a of the piston rod 27 and the hydraulic cylinder 15.

From the above description, it will be understood that the spool member 105 of the regulating valve assembly 91 maintains the chambers 103 and 101 disconnected by the spring 109 when the ports 59 formed at the end of the adjusting shaft 41 are not closed or restricted by the restricting valve member 67 in the piston rod 27. However, when the ports 59 are closed and restricted by the restricting valve member 67, the hydraulic fluid is not free to flow therethrough and therefore is increased in pressure in the passages 57 and 55 of the adjusting shaft 41 and the conduits 79 and 117, and accordingly the spool member 105 is moved away from the chamber 103 by the hydraulic pressure increase in the chamber 99b to connect the chambers 103 and 101. Thus, the spool member 105 is moved to connect the chambers 103 and 101 when the hydraulic fluid acting in the chamber 99b exceeds the pressure prevailing in the chambers 99a and 103 because of the closure of the ports 59. Also, once the chambers 103 and 101 are connected with each other, the the hydraulic fluid prevailing in the chamber 17a of the hydraulic cylinder 15 will be drained from the port 93 through the passage 113, the chamber 99a, the passage 107 and the chambers 103 and 101 of the regulating valve assembly 91 and the drain conduit 121 to the hydraulic tank T. Accordingly, the hydraulic fluid will no longer act to extend the piston rod 27 out of the hydraulic cylinder 15, when the ports 59 are closed by the restricting valve member 67 which is moved by the adjusting screw member 33 movable together with the piston rod 27. Thus, the piston rod 27 is stopped from extruding out of the hydraulic cylinder 15 when the adjusting screw member 33 has moved the restricting valve member 67 close to the flanged portion 53 of the adjusting shaft 41 to close or restrict the ports 59 formed thereat. Therefore, it will be understood that the stroke length of the piston rod 27 can be adjusted by changing the location of the adjusting screw member 33 in the piston rod 27 by rotating the handwheel 47, 47'.

In this connection, the ports 59 of the adjusting shaft 41 are not completely closed, but are kept opened by a certain amount of clearance even when closed or restricted by the restricting valve member 67 to stop the piston rod 27 from extending out of the hydraulic cylinder 15. Such an amount of the clearance, by which the hydraulic fluid flows into the chambers 29 and 17a of the piston rod 27 and the hydraulic cylinder 15 when the ports 59 are closed or restricted, is determined only by the force of the spring 109 of the regulating valve assembly 91 and therefore it is always substantially fixed even if the hydraulic pressure is changed. Accordingly, the piston rod 27 is always positively and accurately stopped from extending whether the hydraulic pressure acting in the hydraulic cylinder 15 is increased or reduced because of the changes of the working resistance or load.

As is readily apparent, the piston rod 27 is retracted into the hydraulic cylinder 15 when the hydraulic fluid is supplied into the chamber 17b of the hydraulic cylinder 15 from the pump 85. Also, when the piston rod 27 is being retracted, the hydraulic fluid in the chambers 17a and 29 of the hydraulic cylinder 15 and the piston rod 27 is exhausted therefrom through the passages 55 and 71 of the adjusting shaft 41 to be returned to the hydraulic tank T. In this connection, the hydraulic fluid is exhausted from the chambers 17a and 29 in large quantities through the port 61 against the ball valve member 63 as well as through the ports 59, and accordingly the piston rod 27 can be rapidly retracted into the hydraulic cylinder 15.

As has been described above, the piston rod 27 is stopped from extending out of the hydraulic cylinder 15 when the adjusting screw member 33 urges the restricting valve member 67 to close or restrict the ports 59 provided at the flanged portion 53 of the adjusting shaft 41. Accordingly, the stroke length of the piston rod 27 can be adjusted by changing the location of the adjusting screw member 33 in the piston rod 27 by rotating the handwheel 47, 47', as has been described hereinbefore. Also, in adjusting the stroke length of the piston rod 27, it is possible to stop and move the piston rod 27 as needed by rotating the handwheel 47, 47'. In order to stop the piston rod 27 from moving, it is only necessary to rotate the handwheel 47, 47' so as to bring the adjusting screw member 33 into contact with the restricting valve member 67 to close or restrict the ports 59. Also, the piston rod 27 which has been stopped from extending out of the hydraulic cylinder 15 can be easily moved again only by rotating the handwheel 47, 47' so as to bring the adjusting screw member 33 away from the restricting valve member 67 to open the ports 59. Of course, when the piston rod 27 is extended beyond a desired position out of the hydraulic cylinder 15, it can be retracted thereinto by so setting the solenoid operated valve 83 as to supply the hydraulic fluid into the chamber 17*b* of the hydraulic cylinder 15. Thus, in the hydraulic press 1 shown in FIG. 1, it is possible to adjust the stroke length of the piston rod 27 by observing the work sheet W placed on the lower tool 7. Also, the hydraulic fluid is always kept pressurized in the chambers 29 and 17*a* of the piston rod 27 and the hydraulic cylinder 15, and therefore the piston rod 27 and the upper tool 11 could be not undesirably moved by the resilience of the work sheet W when the stroke of the piston rod 27 is being adjusted. Of course, after the stroke length of the piston rod 27 has been determined in the above manner, the piston rod 27 will be reciprocated by the determined stroke length to work a reciprocating member such as the ram 9 of the hydraulic press 1.

Figure 3:
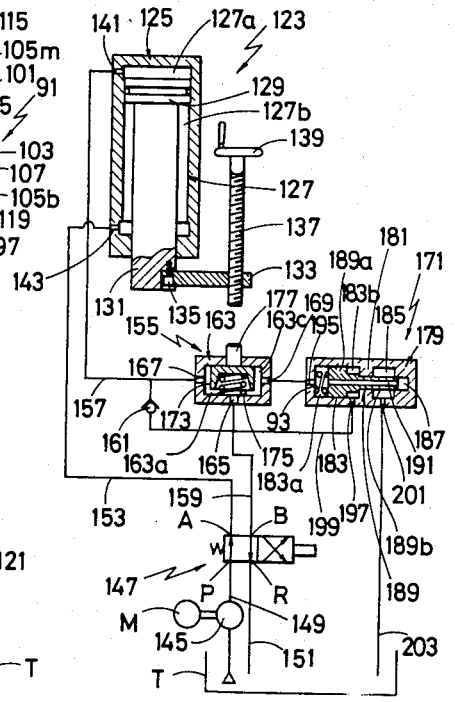
FIG. 3 is a cross-sectional, partly schematic view of a modified embodiment of the stroke-adjusting drive mechanism of the present invention and a hydraulic circuit.

Referring now to FIG. 3, there is shown a modified embodiment of the present invention which is generally applicable to smaller types of machines including the hydraulic press 1 shown in FIG. 1. In the modified embodiment, the hydraulic drive motor assembly which is generally shown by the numeral 123 comprises a hydraulic cylinder 125 which has a chamber 127 and includes therein a conventional piston 129 having a piston rod 131 and dividing the chamber 127 into two chambers 127*a* and 127*b*. The piston rod 131 is of course so disposed as to project out of the hydraulic cylinder 125, and it is provided at its projecting end with an arm member 133 fixed thereto by a suitable means such as a bolt 135. The arm member 133 is provided at its free end with an elongate adjusting screw 137 which is engaged in a threaded bore formed through the arm member 133 to extend in parallel with the piston rod 131 and is provided with a handwheel 139 at its end projecting on the side of the hydraulic cylinder 125. Thus, the adjusting screw 137 is moved together with the piston rod 131, and also it is so arranged as to be adjustingly moved through the arm member 133 in parallel with the piston rod 131 to extend out of and retract into the arm member 133 with the piston rod 131 when the handwheel 139 is rotated.

The hydraulic cylinder 125 is formed with ports 141 and 143 which open outwardly from the chambers 127*a* and 127*b*, respectively, and it is connected with a hydraulic pump 145 through a solenoid operated valve assembly 147 which is of a two position type having four ports A, B, P and R in the preferred embodiment. The pump 145 is connected with a hydraulic tank T and driven by a motor M in the conventional manner, and the solenoid operated valve assembly 147 is connected with the pump 145 and the hydraulic tank T through a conduit 149 and a drain conduit 151, respectively. The solenoid operated valve assembly 147 is directly connected with the chamber 127*b* of the hydraulic cylinder 125 through a conduit 153, but it is connected to the chamber 127*a* of the same through a restricting valve assembly 155 which is connected to the chamber 127*a* and the solenoid operated valve assembly 147 through conduits 157 and 159, respectively. Also, there is provided between the conduits 157 and 159 a bypass having a check valve 161 which is so arranged as to allow the hydraulic fluid to drain therethrough from the chamber 127*a* of the hydraulic cylinder 125 but prevent the same from flowing therethrough from the solenoid operated valve assembly 147. Thus, the hydraulic fluid is supplied from the pump 145 alternatively into either of the chambers 127*a* and 127*b* by the solenoid operated valve assembly 147 while it is drained from the other of the chambers 127*a* and 127*b* to the hydraulic tank T.

The restricting valve assembly 155 comprises a casing 163 which has an interior chamber 163*c* and is formed with a port 165 connecting with the conduit 159, a port 167 connecting with the conduit 157 and another port 169 connected to a regulating valve assembly 171 to be described hereinafter. The port 165 is formed at the central portion of the casing 163, while the ports 167 and 169 are formed at the opposite sides of the casing 163. The casing 163 of the restricting valve assembly 155 includes therein a movable restricting valve member 173 which is of such a size as to form an aperture 163*a* between the casing 163 and the valve member 173 and is biased away from the port 165 by a spring 175. The restricting valve member 173 is provided on the side thereof opposite to the spring 175 with a projecting pin member 177 which is slidably projected out of the casing 163 through a bore which is formed through the casing 163. Also, the restricting valve assembly 155 is so located that the projecting pin member 177 may be contacted and pushed by the end of the adjusting screw 137 when the piston rod 131 is extended out of the hydraulic cylinder 125 together with the adjusting screw 137. Thus, when the piston rod 131 is extruded, the adjusting screw 137 will be brought into contact with the projecting pin member 177 and press the restricting valve member 173 to gradually close the aperture 163*a* to restrain the hydraulic fluid from flowing therethrough.

The regulating valve assembly 171 of the modified embodiment is all the same in construction and function as that 91 of the first embodiment shown in FIG. 2. In all the same manner as the first embodiment, the regulating valve assembly 171 comprises a casing 179 which has chambers 183 and 185 divided by a wall 181 and another chamber 187 formed connected with the chamber 185. The casing 179 includes therein a slidable spool member 189 which is formed at its axial center with an elongate passage 191 and has a larger diameter portion 189*a* dividing the chamber 183 into two chambers 183*a* and 183*b* and a smaller diameter portion 189*b* fitting in the chamber 187. The spool member 189 is biased by a spring 193 disposed in the chamber 183*a* toward the chamber 187 so as to keep the smaller diameter portion 189*b* disconnecting the chambers 187 and 185. The chamber 183*a* is formed with a port 195 and is connected therethrough to the port 169 of the restricting valve assembly 155, while the chamber 183*b* is formed with a port 197 to which a conduit 199 is connected to lead to the conduit 159 between the solenoid operated valve assembly 147 and the restricting valve assembly 155. Also, the chamber 185 of the regulating valve assembly 171 is formed with a port 201 to which a drain conduit 203 is connected so as to lead to the hydraulic tank T.

As will be now understood, the piston rod 131 in the modified embodiment is stopped from extending out of the hydraulic cylinder 125 in the same manner as the first embodiment. When the piston rod 131 is to be extended out of the hydraulic cylinder 125, the hydraulic fluid is supplied into the chamber 127*a* of the hydraulic cylinder 125 from the pump 145 through the solenoid operated valve assembly 147, the restricting valve assembly 155 and the conduit 157. As the piston rod 131 is extended out of the hydraulic cylinder 125, the adjusting screw 137 is moved, together with the piston rod 131, into contact with the projecting pin member 177 of the restricting valve assembly 155 and urges the restricting valve member 173 to gradually close or restrict the aperture 163*a*. When the aperture 163*a* of the restricting valve assembly 155 is on the point of being closed or restricted, the hydraulic fluid is restrained from flowing therethrough and accordingly is increased in pressure in the conduits 159 and 199 and also in the chamber 183*b* of the regulating valve assembly 171. Once the hydraulic pressure is increased in the chamber 183*b* of the regulating valve assembly 171, the spool member 189 is moved against the spring 193 away from the chamber 187 to connect the chambers 187 and 185. As the result, the hydraulic fluid is drained from the restricting valve assembly 155 to the hydraulic tank T through the chamber 183*a*, the passage 191 and the chambers 187 and 185 of the regulating valve assembly 171 and accordingly the hydraulic fluid no longer acts to to extend the piston rod 131. However, it will be understood that the piston rod 131 will begin to further extend from the hydraulic cylinder 125 when the handwheel 139 of the adjusting screw 137 is rotated to bring the adjusting screw 137 away from the projecting pin member 177 of the restricting valve assembly 155.

As is readily understood, the piston rod 131 is retracted into the hydraulic cylinder 125 when the hydraulic fluid is supplied into the chamber 127*b* of the hydraulic cylinder 125 from the pump 145 through the solenoid operated valve assembly 147. Also, when the piston rod 131 is being retracted, the hydraulic fluid in the chamber 127*a* of the hydraulic cylinder 125 is drained therefrom in large quantities to the hydraulic tank T through the check valve 161 as well as the restricting valve assembly 155 so that the piston rod 131 may be rapidly retracted.

From the above description, it will be now understood that the stroke length of the piston rod 131 can be easily adjusted by rotating the handwheel 139 of the adjusting screw 137 in the modified embodiment in the same manner as the first embodiment shown in FIG. 2. Also, it will be understood that the modified embodiment is effectively applicable to smaller types of machines using a smaller hydraulic cylinder.

Although a preferred form of the present invention has been illustrated and described, it should be understood that the device is capable of modification by one skilled in the art without departing from the principles of the invention. Accordingly, the scope of the invention is to be limited only by the claims appended hereto.

I claim:

1. Apparatus for adjusting the stroke of a reciprocating member in a hydraulic drive mechanism comprising a cylinder, a piston movable in said cylinder, said piston defining a first chamber in said cylinder and having a piston rod extending outwardly from said cylinder, a conduit connected to hydraulically communicate said first chamber with hydraulic pump means for supplying pressurized fluid to said first chamber to move said piston through a stroke in said cylinder, restricting valve means arranged between said first chamber and said conduit for restricting flow therebetween, stroke adjusting means arranged to be adjustably positioned relative to said piston rod for urging said restricting valve means into flow restricting relation between said first chamber and said conduit at a predetermined position along said stroke, said piston rod being formed with a cylindrical chamber having a threaded inner wall, said stroke adjusting means including a shaft member rotatably arranged in said cylindrical chamber and a rotatable adjusting member threadably engaged with said threaded inner wall, said shaft member extending slidably through said adjusting member, said restricting valve means being located at the end of said shaft member, and said adjusting member contacting said restricting valve means to urge the same into said flow restricting relation when said shaft member and said adjusting member are rotated to axially move said adjusting member in said cylindrical chamber and said piston is subsequently moved through its stroke in said cylinder.

2. Apparatus for adjusting the stroke of a reciprocating member in a hydraulic drive mechanism comprising a cylinder, a piston movable in said cylinder, said piston defining a first chamber in said cylinder and having an integral piston rod extending therefrom, said piston rod having an axial internal threaded bore, a conduit connected to hydraulically communicate between said first chamber with hydraulic pump means for supplying pressurized fluid to said first chamber to move said piston through a stroke in said cylinder, restricting valve means arranged between said first chamber and said conduit for restricting flow therebetween, stroke adjusting means for urging said restricting valve means into flow restricting relation between said first chamber and said conduit at a predetermined position along said stroke, said stroke adjusting means including a shaft member rotatably arranged in the internal bore of the piston rod, a rotatable adjusting member threadably engaging said internal bore and being slidably penetrated by said shaft member, and rotation of said shaft member and said adjusting member causes axial movement of said adjusting member along said internal bore and said piston subsequently moves through its stroke in said cylinder such that said adjusting member contacts said restricting valve means to urge the same into said flow restricting relation.

* * * * *